United States Patent [19]

Bursey et al.

[11] 4,038,158

[45] July 26, 1977

[54] ELECTROCHEMICAL GENERATION OF FIELD DESORPTION EMITTERS

[75] Inventors: Maurice M. Bursey, Chapel Hill, N.C.; Deborah M. Hinton, Champaign, Ill.; Martin C. Sammons, Cincinnati, Ohio; R. Mark Wightman, Lawrence, Kans.

[73] Assignee: E. I. Du Pont de Nemours and Company, Wilmington, Del.

[21] Appl. No.: 624,102

[22] Filed: Oct. 22, 1975

[51] Int. Cl.[2] ..... C25D 5/18; C25D 5/00; C25D 7/00

[52] U.S. Cl. ..... 204/23; 204/39; 204/228; 204/DIG. 9

[58] Field of Search ..... 204/23, 10, DIG. 9, 204/27, 228, 39

[56] References Cited

U.S. PATENT DOCUMENTS

| | | | |
|---|---|---|---|
| 2,116,927 | 5/1938 | Germer | 204/23 |
| 2,443,599 | 6/1948 | Chester | 204/DIG. 9 |
| 2,548,867 | 4/1951 | Chester | 204/DIG. 9 |
| 3,323,951 | 6/1967 | Kreiselmaier | 204/10 |
| 3,616,434 | 10/1971 | Hausner | 204/DIG. 9 |
| 3,684,480 | 8/1972 | Louzos | 204/10 |
| 3,690,866 | 9/1972 | Louzos | 204/10 |
| 3,801,413 | 4/1974 | Block et al. | 204/18 R |

FOREIGN PATENT DOCUMENTS

| | | | |
|---|---|---|---|
| 298,728 | 5/1917 | Germany | 204/23 |

*Primary Examiner*—T. M. Tufariello

[57] ABSTRACT

An electrochemically generated field desorption emitter for use in mass spectrometry, and a process for forming such an emitter by immersing a metal support, as a first electrode, and a second electrode in an electrolytic liquid mixture having appropriate concentration of a metal compound, and applying a plurality of short duration, electrical pulses between the electrodes. The emitter so formed comprises an elongated metal support having a plurality of metal dendrites extending in a generally radially outwardly direction therefrom.

15 Claims, 9 Drawing Figures

ELECTROCHEMICAL GENERATION OF FIELD DESORPTION EMITTERS

BACKGROUND OF THE INVENTION

1. Field of the Invention

The present invention relates to emitters for use as ion sources in mass spectrometry. In particular, it relates to field desorption emitters and to a process for their manufacture.

2. Discussion of the Prior Art

Mass spectrometry, although a powerful analytical technique, has been hindered, until recently by its requirement for sample volatility. The need to evaporate the sample before ionization, and the ionization process itself, have meant that highly polar, non-volatile compounds could not be studied. Conventional electron impact mass spectrometry imparts up to 70 eV energy to the sample, resulting in many fragmentation peaks and few, if any, molecular ion peaks for relatively polar compounds. The newer and more gentle processes of chemical ionization and field ionization do produce molecular ion peaks for fairly polar compounds, but the evaporation process involved in these techniques still requires enough energy to decompose many polar substances. Unfortunately, many compounds of biological and biochemical importance, such as nucleotides, nucleosides, carbohydrates, steroids, and amino acids, are polar, and their molecular weight determinations by electron impact, chemical ionization and field ionization have been mostly unsuccessful. The development of field desorption mass spectrometry has given rise to techniques applicable to these compounds and has extended the usefulness of mass spectrometry to even the most polar samples.

Field desorption involves the use of a high electric field gradient to induce tunneling of an electron from a sample to the surface on which that sample is absorbed. After the sample molecule loses its electron, it is repelled by the positively charged surface on which it is located and is driven into the gas phase by coulombic repulsion. The ions thus created enters the mass spectrometer analyzer region, are separated according to their mass to charge ratios, and are detected in the usual fashion.

There are several advantages that field desorption has over other types of ion formation techniques for mass spectrometry, especially when dealing with polar, non-volatile samples. First of all, unlike electron impact or field emission, the sample is not vaporized by heating before it is introduced into the ionization region. Instead it is adsorbed directly onto the site where ionization occurs. Samples which thermally decompose, therefore, will produce molecular ion peaks when field desorption ionization is used even though no such peaks are observed when electron impact ionization or field ionization are used. The ionization process involved in field desorption ionization is more gentle than that involved in electron impact ionization or in chemical ionization. Much less energy is imparted to the sample than the 70 eV normally used in electron impact ionization or the tens of kilocalories per mole used in chemical ionization. Therefore, less fragmentation occurs and the intensity of the molecular ion peak is correspondingly increased. The molecular ion peak intensity is further increased by the decreased length of time the molecular ions spend in the ionization region, because less time exists for the molecular ion to fragment. Finally, the decrease in fragmentation peak intensities and the corresponding increase in molecular ion peak intensities reduces the number of peaks in the spectrum produced by field desorption ionization, simplifying the identification of the unknown sample.

In field desorption, the sample is usually adsorbed onto the emitter, by dipping the emitter into the sample or applying the sample directly to the emitter using a syringe. The emitter is heated and the sample evaporated, as an ion, from it under the influence of the electric fields in the region of the emitter. In designing the emitter, therefore, two factors should be considered: (1) the geometry of the emitter surface, and (2) the surface area of the emitter. The geometry of the emitter surface determines the electric field strength experienced by the absorbed sample. The smaller the surface radius of curvature the higher the electric field, so it is desirable to have an emitter surface with either sharp edges or sharp points where very high electric fields can be obtained. Also, since the surface is intended to hold the sample solution, it is desirable to have an emitter with as large a surface area as possible so that an adequate amount of sample can be adsorbed onto the emitter.

In order to meet the requirements of the sharp points, the original field desorption emitters were thin platinum wires (2.5 $\mu$m in diameter), thin foils, or razor blades. However, these emitters did not have surface areas large enough to accommodate an adequate amount of sample. The next type of emitter used was a thin wire on which a number of organic polymer crystals or carbon microneedles had been grown. The growth of these needles greatly increased the amount of ion current. These emitters were initially produced at low temperatures using acetone to form a polymer, but an attempt made to find the best chemical substance for needle growth led to the use of benzonitrile at high temperatures to produce carbon microneedles. Greater mechanical strength was obtained when a tungsten wire used as the support on which the needles were generated. This process generates carbon microneedles which exhibit good mechanical strength (they can be used as many as ten times) and which are affected only slightly by the sample being desorbed or by the high electric field. These sources, however, are difficult to produce. The equipment required for needle growth is elaborate, involving a good vacuum system ($10^{-5}$ Torr) and a high voltage power supply (12 KV). Furthermore, benzonitrile is toxic, and the growth process requires a substantial amount of time (about 8 hours) with only a 50% success rate.

Recently, Gol'denfel'd et al. have done some work on the electrochemical deposition of low vapor pressure metals such as zinc, copper and iron to form emitters having metal dendrites attached to a tungsten support. This work was reported in the Journal of Instruments and Experimental Techniques, Vol. 3, p. 166–168. While these filaments have a developed surface, the dendrites are generally short and the relatively high vapor pressure of the material from which they are made reduces their usefulness as a field desorption source.

There is, therefore, the need for a field desorption emitter which can be produced by a simple, reliable process, free from the disadvantages referred to above.

SUMMARY OF THE INVENTION

According to this invention, there is provided a process for forming a field desorption source comprising a metal support and a plurality of metallic dendrites attached to and extending in a generally radially outwardly extending direction from the support, which comprises the steps of:

a. forming an electrolytic mixture having an appropriate conncentration of a compound of the metal from which the dendrites are to be formed;
b. immersing the support, as a first electrode, in the mixture;
c. immersing a second electrode in the mixture in electrodepositing association with the support; and
d. applying a plurality of short duration electrical pulses between the electrodes.

The electrolytic mixture can be either ionic or covalent, but in the preferred embodiment, the step of forming an electrolytic mixture comprises forming an aqueous solution of a compound containing a metal selected from the group consisting of nickel, cobalt, manganese, silver, rhenium, niobium, tantalum, and chromium, and the step of applying a plurality of electrical pulses between the electrodes comprises applying at least two series of pulses, separated by a relaxation period during which no electrical pulses are applied between the electrodes.

Under certain circumstances, it is advantageous to heat or cool the mixture while applying the electrical pulses. Furthermore, when the support is a tungsten wire, it is advantageous to clean the support, prior to immersion in the mixture, by immersing the support in an organic solvent, then in a solution containing nitric and hydrofluric acid, and then washing the support in distilled water.

The field desorption emitter produced by this process comprises a metal support, preferably elongated, having attached thereto in a generally radially outwardly extending direction a plurality of metal dendrites. In the preferred embodiment, dendrites having a length of at least 10$\mu$, preferably 20$\mu$, are formed from the material selected from the group consisting of silver, nickel, cobalt, chromium, rhenium, manganese, tungsten, niobium, tantalum, and molybdenum.

BRIEF DESCRIPTION OF THE DRAWINGS

The present invention can best be described with reference to the following figures in which.

DESCRIPTION OF THE PREFERRED EMBODIMENT

Figure 1:
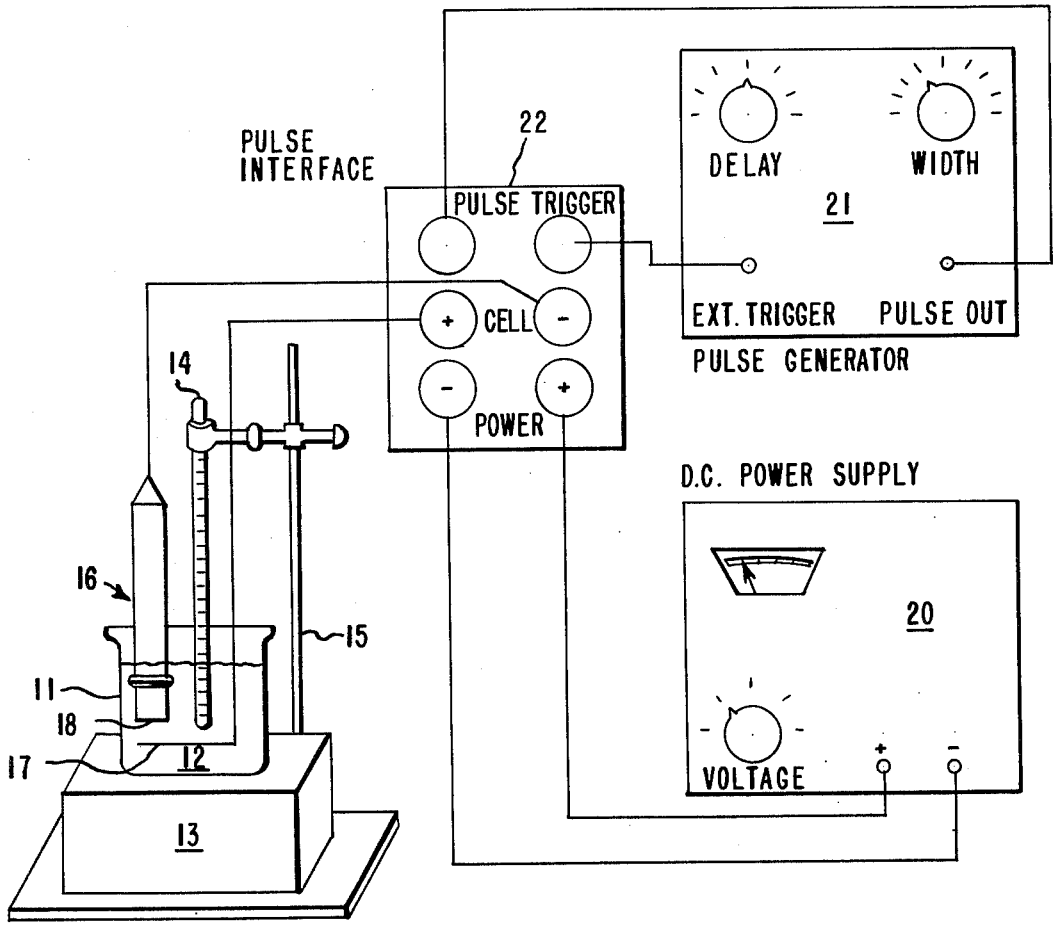
FIG. 1 is a schematic diagram of an electroplating apparatus which can be used to practice the present invention.

An apparatus for producing the field desorption emitters of the present invention is shown schematically in FIG. 1. A small beaker 11 for the electroplating mixture 12 is positioned on top of a heating plate 13. A thermometer 14 is supported in the electroplating mixture by a stand 15. The emitter shown generally by 16 is immersed in the electroplating mixture as a cathode, and another wire, 17, which is used as the anode, is also immersed in the electroplating mixture.

Figure 3:
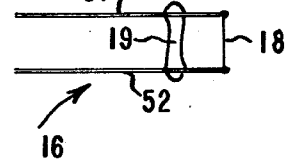
FIG. 3 is a side view of a field desorption emitter.

The anode can be constructed from any material, well known to those skilled in the art. A platinum wire has been found to be suitable under most circumstances. The emitter structure, 16, shown in more detail in FIG. 3, consists of an elongated support 18 which is supported by two posts 51 and 52, separated by a glass bead 19. In the embodiment shown, the support is a thin wire. The posts can be made from any suitable material known to those skilled in the art. Tungsten or an iron-nickel-cobalt alloy sold under the tradename Kovar can be used. The support is electrically connected to the posts in a fashion, well known to those skilled in the art, such as spot welding. Any suitable material such as platinum or tungsten can be used for the support, however, because of its high melting point, resistance to corrosion and mechanical strength, tungsten is particularly suitable. In the embodiment illustrated, the support is an elongated support formed from a 10 $\beta$ tungsten wire, but any suitable support, such as a support formed by the ends of a plurality of wires in a bundle, can be used.

As shown in FIG. 1, emitter structure 16 is immersed in the electroplating mixture to at least cover the support 18 and the support is positioned parallel to and in electrodepositing association with anode 17. The separation between the two electrodes depends upon the particular electroplating mixture and the conditions used, however, a separation of between 0.5 to 2.0 cm., preferably 0.8 to 1.0 cm., is suitable.

There are four parameters that have been found to be important in the formation of a filed desorption emitter: (1) the metal from which the dendrites are to be formed and hence the type and concentration of the electroplating mixture containing the metal ions, (2) the temperature of the electroplating mixture, (3) the potential applied between the electrodes, and (4) the time interval during which the potential is applied and the time between pulses.

Since in field desorption experiments, it is usually necessary to heat the emitter when desorbing the sample, the metal from which the dendrites are formed should have a low vapor pressure and a high melting point. Since the emitter must be able to withstand being dipped in the sample and the stresses of a 10 KV field, the metal from which the dendrite is formed should also have good mechanical strength. Furthermore, since the emitter should be resistant to chemical attack from the sample or be damaged by exposure to normal room conditions while being stored for use, the metal from which the dendrites are formed should be chemically inert. Finally, the metals should be amenable to easy dendrite growth. The following metals are representative of those which fulfill the above criteria: silver, nickel, cobalt, manganese, molybdenum, tungsten and rhenium. Many other metals are certainly suitable.

The metals may be present as metal ions or covalent compounds in an electrolytic liquid mixture. Normally, the compound is present in an electrolytic solution, preferably an aqueous solution, however, not all suitable metals plate well from an aqueous solution. Silver nitrate, nickel chloride, nickel sulfate, nickel nitrate, manganese chloride, and manganese sulfate are all soluble in water and the metals plate well from an aqueous solution. While molybdenum and tungsten do not plate well from aqueous solutions, they will plate from molten salt mixtures. Canadian Pat. No. 688,546 describes a process for plating these metals from eutectic molten salt mixtures. The method for molybdenum deposition employs the use of potassium molybdenum hexachloride in a potassium chloride and sodium chloride melt at 700° C. Unless this procedure is carried out in the absence of oxygen and water, a black powdery metal oxide is plated. Thus, the apparatus used in such a process must be more elaborate than that set forth above. Finally, rhenium has been plated using an aqueous solution of potassium perrhenate to which enough sulfuric acid has been added to set the pH at less than one. Sodium perrenate, which has a higher solubility in water, may also be used.

Solutions of covalent compounds, such as metal chelate compounds, in particular nickel acetyl acetonate, have been found to be effective.

The desire is to electrochemically generate metal dendrites. This type of tree or needle-like plating occurs when the concentration and voltage gradients are such that the metal plates preferentially onto sites where the metal has already been plated, thus causing tree-like protrusions rather than uniform plating. It has been proposed that dendritic growth is optimized when the concentration is low, so that the diffusion rate is low and crystals are able to grow only at sites where material is available. However, it now appears that dendritic growth is favored at higher concentrations. Tajima and Ogata is their article on "Electrocrystallization of Ni, Co and Fe Dendrites From Aqueous Solutions" which appeared in Electrochemica Acta, 13, 1845 (1968) have found that dendrite formation can be obtained from more nearly saturated solutions. Dendritic formation has been achieved using concentrations ranging from $2 \times 10^{-5}$ Molar (M) to 4.8 M solution, with the higher concentrations, 2–4 M, being preferred. Naturally, the optimum concentration to preferentially obtain dendrite formation rather than uniform plating will have to be determined for each solution, but such a determination is well within the capability of one of ordinary skill in the art.

Temperature also appears to affect dendritic growth. For nickel chloride and nickel nitrate solutions, temperatures ranging from room temperature to about 105° C. have been effectively used, with the preferable temperature in the range of about 60° to 90° C. For manganese sulfate, however, the optimum temperature was found to be about 5° C.

Peak voltage amplitudes applied between the emitter and the anode do not appear to be too critical. Peak voltage amplitudes in the range between 5 to 120 V, preferably 20 to 60 V, have been found to be suitable, with the higher voltages preferable. Metal dendrite formation does not require the very high voltages (10 KV) required for carbon dendrite formation.

It has been found that metal dendrite formation is enhanced if the voltage is supplied in a series of short duration electrical pulses. Pulse duration of between about 0.001 and 0.1 second, preferably about 0.001 to about 0.01 second, have been found to be suitable, with between about 5 and about 20 pulses of such duration being applied in about 0.001 to about 3 second intervals. It has also been found that about 3 to about 10 pulses, followed by a comparable relaxation period during which no electrical pulses are applied, then followed by at least one additional series of about 3 to about 10 pulses enhances dendrite formation. Furthermore, it has been found that the density and length of the dendrites can be varied by applying the initial pulses at a low voltage of 20 to 30 volts and the remaining pulses at a higher voltage of 60 volts.

Figure 2:
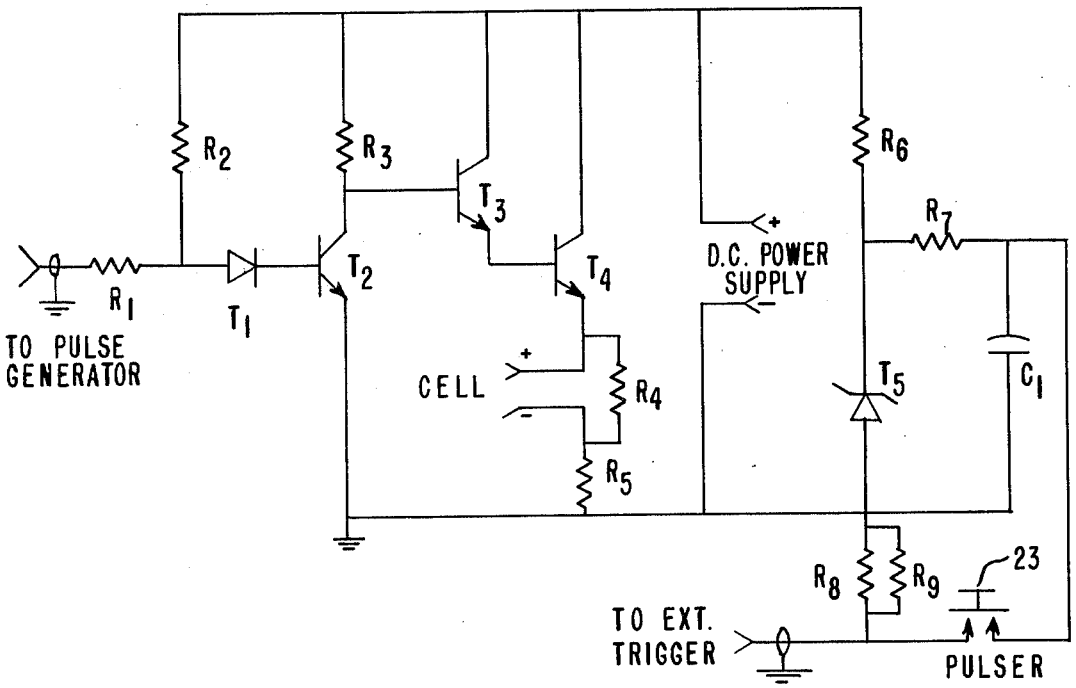
FIG. 2 is a schematic diagram of a pulse interfaced used in conjunction with the apparatus of FIG. 1 to practice the present invention.
Figure 5:
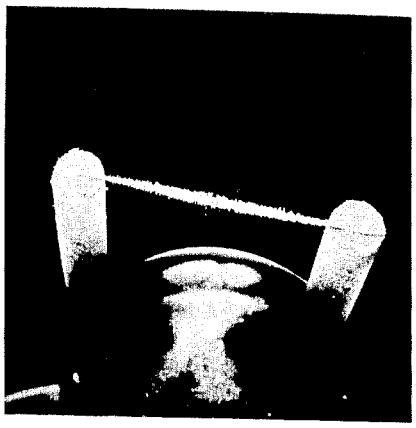
FIGS. 5, 6 and 7 are scanning electron microscope images ($\times$20, $\times$ 200, and $\times$ 2000 magnification, respectively) of one embodiment of the emitter of the present invention.
Figure 6:
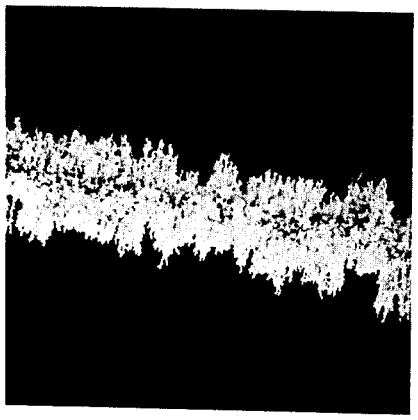
Figure 7:
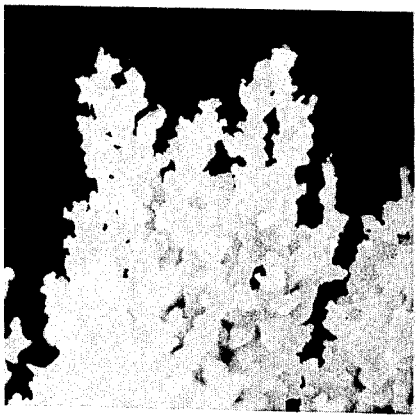

FIGS. 5, 6 and 7 are scanning electron microscope photographs of a nickel emitter prepared using the preferred pulsed voltage technique. FIG. 5 is a ×20 magnification view of the emitter structure 16 showing, in the center, the dendritic growth of nickel on the 10 μ tungsten wire. FIG. 6 is a ×200 magnification view of the central portion of the emitter of FIG. 5. The dendritic growth is more apparent in this figure. FIG. 7 is a ×2000 magnification view of the ends of the dendrites shown in FIG. 6. Visible in this figure are the many sharp ends of the dendrites that are necessary for good field desorption operation discussed above. Also visible is the large surface area available for absorption of the sample. Referring once more to FIG. 1, power is supplied to electrodes 17 and 18 by a d.c. power supply, capable od current outputs of to 2–10 amps at voltages of 0–120 volts. Any suitable d.c. power supply well known to those skilled in the art can be used. The voltage applied between the electrodes was supplied in pulses triggered by a square wave generated by a pulse generator 21. Any conventional pulse generator well known to those skilled in the art can be used. Pulse interface 22 is provided so that the electrical pulses applied to the electrodes can be triggered by the operation of an external pulser switch 23 (FIG. 2) which produced a single pulse of duration from 1 second to 1 millisecond as set by the pulse generator. Pulse interface 22 is shown schematically in FIG. 2. The various resistances, capacitances, and solid state devices used are identified in Table I.

TABLE I

| | Resistance (kilohms) | | Capacitance (μf) |
|---|---|---|---|
| $R_1$ | 4.7 | $C_1$ | 0.01 |
| $R_2$ | 15.0 | | |
| $R_3$ | 1.5 | | Solid State Devices Motorola Designation |
| $R_4$ | 1200.0 | $T_1$ | hep 134 |
| $R_5$ | 0.01 | $T_2$ | hep 728 |
| $R_6$ | 2.2 | $T_3$ | hep 728 |
| $R_7$ | 1000.0 | $T_4$ | hep 743 |
| $R_8$ | 1.0 | $T_5$ | hep 20220 |
| $R_9$ | 0.1 | | |

In conjunction with Zener diode $T_5$ resistors $R_6$–$R_9$ and capacitor $C_1$, d.c. power supply 20 provides a constant potential to the external trigger of pulse generator 21 when the pulser switch 23 is activated. The pulse from pulse generator 21 is applied to the left hand side of the circuit shown in FIG. 2. Resistors $R_1$–$R_3$ and transistors $T_1$–$T_4$ function as a current amplifier. Through them, the d.c. power supply 20 provides a high current pulse between the anode and the cathode of the electrodepositing cell. Resistors $R_4$ and $R_5$ provide a high impedance leakage path to ground. Pulser switch 23 can either be manually operated or connected to a programmable pulsing source.

Figure 4:
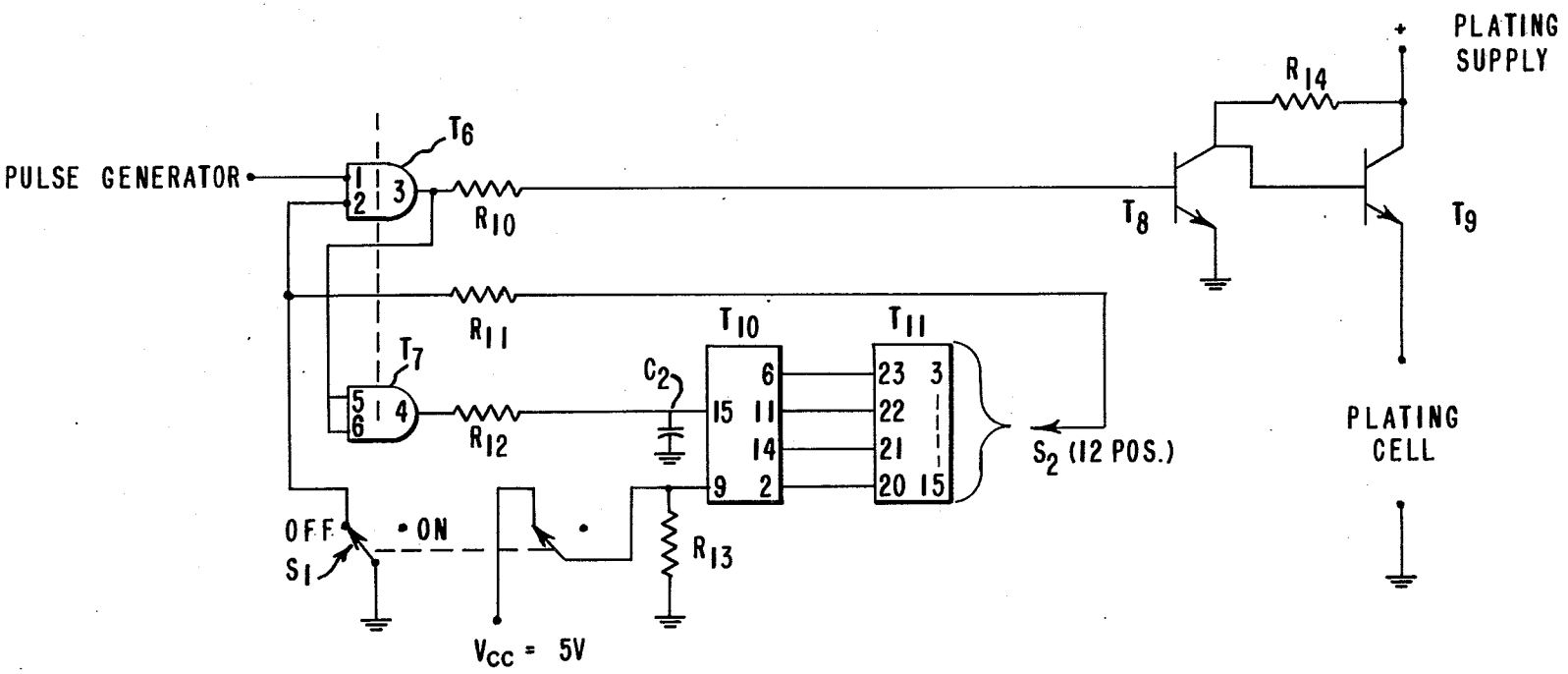
FIG. 4 is a schematic diagram of an automatic pulse interface for use in conjunction with the apparatus of FIG. 1.

One possible automatic pulsing circuit is shown in FIG. 4. Pulse generator 21 (see FIG. 3) provides a square wave pulse train to terminal 1 of device $T_6$. When the on-off switch is in the "off" position, no output appears at terminal 3 of this device. In the "on" position, pulses appear at terminal 3 and hence at terminals 5 and 6 of the device $T_7$ as well as at the base of device $T_8$. The square wave pulse train also appears at terminal 4 of device $T_7$ and hence to terminal 15 of device $T_{10}$. Device $T_{10}$ and device $T_{11}$ serve as a pulse counter system such that depending upon the position of the 12 position switch, $S_2$, a number of pulses from 1 to 12 may be selected. The output of device $T_{11}$ through twelve position switch $S_1$ connected to terminal 2 of device $T_6$ serves to stop the square wave signal at terminal 3 of device $T_6$ when the selected number of pulses have passed. The square wave pulses on the base of device $T_8$ are in turn passed to device $T_9$ causing this device to conduct and not conduct in accordance with the square wave signal. The plating cell connected to device $T_9$ is thus provided with a square wave voltage as established by the plating supply. The various resistances, capacitances and solid state devices used are identified in Table II.

TABLE II

| | Resistance (kilohms) | | Capacitance ($\mu$f) |
|---|---|---|---|
| $R_{10}$ | 10 | $C_2$ | 0.01 |
| $R_{11}$ | 51 | | Solid State Devices (Industry Code) |
| $R_{12}$ | 100 | $T_6$ | CD 4011A |
| $R_{13}$ | 100 | $T_7$ | CD 4011A |
| $R_{14}$ | 10 | $T_8$ | 2N 3053 |
| | | $T_9$ | 2N 6057 |
| | | $T_{10}$ | 14516 |
| | | $T_{11}$ | 74C154 |

It has been found that enhanced dendrite formation is obtained if the support is cleaned before immersion in the electrolytic mixture. If the support is made of tungsten, cleaning can be accomplished by immersing the support in a solution containing nitric acid and hydrofluoric acid, and then washing the support in distilled water. Finally, the emitter must also be cleaned after plating to wash off the plating solution. A washing with distilled water followed by a washing with acetone has been found to be sufficient.

Figure 8:
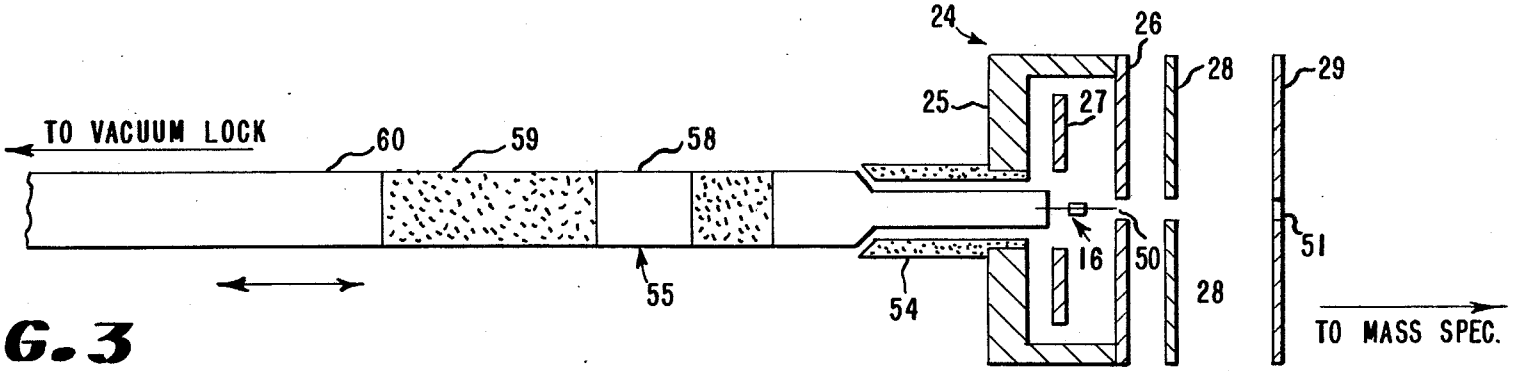
FIG. 8 is a top view of a field desorption source utilizing the emitters of the present invention.
Figure 9:
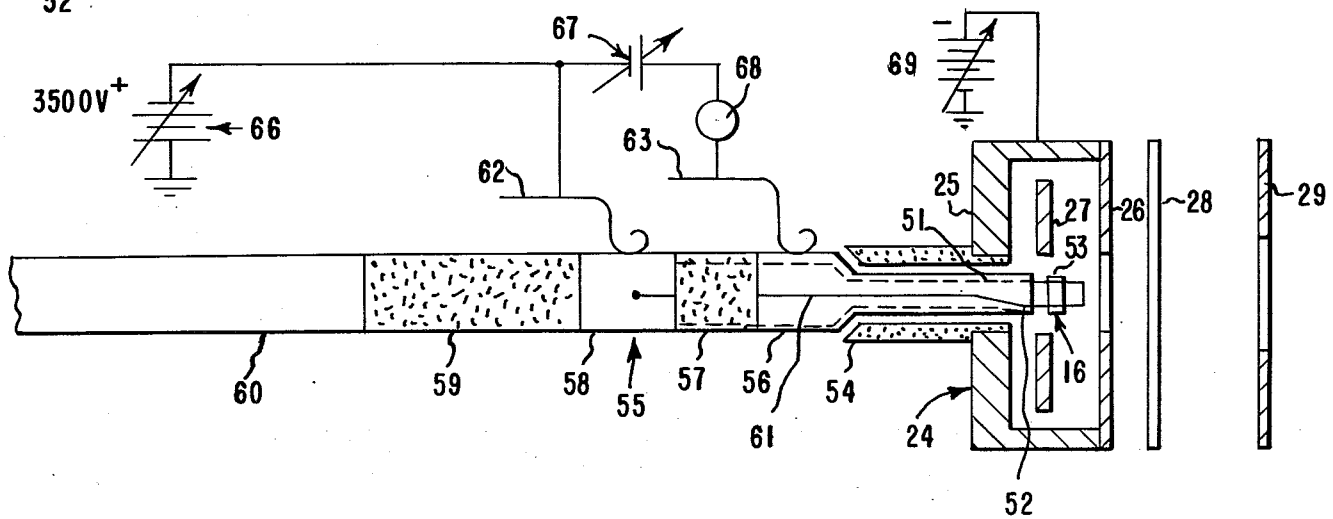
FIG. 9 is a side view of the source shown in top view in FIG. 8.

A typical field desorption source for use in conjunction with mass spectrometers is shown in FIGS. 8 and 9. FIG. 8 is a top view and FIG. 9 is a side view of the same source. The rest of the mass spectrometer is of conventional design and will not be described here. The source consists of an ionization chamber 24 formed from a housing 25 and a front plate 26 which contains a primary slit 50. A repeller electrode 27 is located within the regions formed between housing 25 and plate 26, and a pair of focus plates 28 are located between the primary slit 50 and a terminator slit 51 formed in plate 29. Housing 25 contains a large diameter hole formed in back of the source, opposite primary slit 50. A ceramic insulator 54 is press fit into this hole. The insulator, which is a hollow tube, serves to electrically isolate the emitter holder 55 from the ionization chamber 24 and to guide the emitter into the source. Repeller electrode 27 is provided with a hole large enough to accommodate emitter holder 55.

Emitter 16 comprises a support bonded to two Kovar posts 51 and 52 which are held together by glass bead 53. The support has the metal dendrites referred to above.

The emitter holder is divided into five distinct sections: the first of these, 56, is a hollow metal tube to which Kovar post 51 is connected; the second, 57, is a hollow post made from any suitable insulating material such as Vespel; the third, 58, is a metal support which is connected by wire 61 to the second of the Kovar posts, 52; the fourth, 59, is a ceramic insulator; and the fifth, 60, is a solid metal support rod. Portions 56 and 57 are hollow to accommodate wire 61 which passes through them and contacts Kovar support 52. Wiper contact 62 contacts second contact 58, and wiper contact 63 touches front contact 56.

The entire emitter assembly consisting of emitter 16, contact 56, insulator 57, contact 58, insulator 59 and probe shaft 60 can be removed from the ion source through a vacuum lock (not shown). The vacuum lock has a support system which makes it possible to reproducibly remove the assembly along the axis of the source so that the emitter can be positioned as desired within ionization chamber 25.

Normal operation in the field desorption mode involves the application of a positive potential to the emitter 18 and a negative potential to the ionization chamber 24, or more specifically to plate 26. These potentials are of such magnitude that a total potential difference in the range 6 to 12 kilovolts is obtained. The magnitude of the positive potential is dictated by the design of the particular mass spectrometer being used and the mass range being covered. In the type 21–492 mass spectrometer manufactured by E. I. du Pont de Nemours and Company, the positive potential supply 66 provides 2.7 kilovolts when operated to cover the mass range from 1 to 650 atomic mass units. An emitter heating supply, 67, is also provided to pass a current through emitter 18. The magnitude of this heating current is indicated by meter 68. The source chamber 25, repeller 27, and the plate 26 in which the primary slit 50 is located, have a negative potential of from 4 to 9 kilovolts applied from variable power supply 69. With this combination of voltages, the necessary high gradient is produced at the surface of the emitter 18, with the primary slit 50 being the counter-electrode. Focus plates 28 have an appropriate potential applied to them from a voltage divider, not shown.

EXAMPLE 1

Over 100 nickel dendrite emitters have been grown using the apparatus shown in FIG. 1. The procedure involved the use of nickel chloride solutions with concentrations between $2 \times 10^{-3}$ M and 4M and nickel nitrate solutions with concentrations between 2M and 4M, temperatures between 60° and 105° C., voltage amplitudes between 5 and 30 volts, and pulse durations between 0.001 and 0.01 second. The optimum combination of these four parameters is the use of a 4 M nickel nitrate solution at 90° C., through which ten pulse of 0.01 second duration and 30 V amplitude were passed. The potential drop across this cell was measured to be 25 V and the current to be 0.05 A. This procedure produced tree-like densely spaced (e.g., 0.1 $\mu$) nickel dendrites with an average of 40 $\mu$.

The mechanical strength of the nickel emitters made as set forth above appear to be only slightly less than those of the carbon emitters made by the process of the prior art. They may be washed in running water and are not detectably affected by the stress of high electric field. Their susceptibility to damage by sparking, however, may be slightly greater.

The thermal stability of the nickel microneedles on the emitters is somewhat lower than that of the carbon microneedles. It has been observed that heating to 1000° C. destroys their utility. However, if the temperature is kept below that produced by 45 mA, no thermal degradation occurs. In fact, heating to more than 30 mA in a vacuum is advisable before the use of the nickel emitters. This treatment yields better ion currents, presumably as a result of the removal of surface impurities.

The chemical stability of the nickel microneedles produced by the process described above also appears to be good. An emitter exposed to perfluorotributylamine at a pressure of $1.5 \times 10^{-5}$ Torr and an ionization voltage of 16 kV for 35 minutes showed no visible damage.

To compare the nickel dendrites with the carbon microneedles, several sensitivity tests were conducted. Samples selected for the tests were solutions of tetraethylammonium borohydride ($9 \times 10^{-4}$ g. in 70 liters of water), methyltriphenylphosphonium bromide ($2.1 \times 10^{-1}$ g. in 5 ml. water), ascorbic acid (2.0 grams in 10 ml. water), pyridoxal phosphate ($2 \times 10^{-2}$ g. in 2 ml. water), and glucurondactone (2.0 g. in 10 ml. water), the latter three solutions being saturated. The samples were field desorbed with both the nickel dendrite emitters and carbon microneedles using the following procedure. The emitter was dipped into each solution for 10 seconds, then placed in a field desorption source. Before a field desorption spectrum was taken, acetone, at a pressure of $3 \times 10^{-5}$ Torr, was injected into the source and field ionized. The emitter was then positioned to achieve a maximum field ionization ion current current keeping the wire approximately 1 mm. from and parallel to the anode, with the center of the wire at the center of the slit. After sufficient pumping to remove the acetone (5 minutes) the sample was field desorbed by heating the wire at a rate of 1 ma per 30 seconds. The entire spectrum was recorded on a photoplate and the intensity of the individual photoplate lines was recorded. A comparison of the sensitivity of the nickel and carbon microneedles in field desorption work was made by comparing the photoplate intensities, derived from the densities of the molecular ion species and a modified Churchill two line method. These results, shown in Table III, show that the nickel dendrites compare favorably with the carbon emitters. The former appeared to give higher ion currents for salts (the tetraethylammonium borohydride and the methyltriphenylphosphonium bromide), but somewhat smaller values for the ascorbic acid and the glucuronolactone.

TABLE III

| | | Type of Emitter | Photoplate Intensity (Relative to 1.00 carbon emitter) |
|---|---|---|---|
| I. | $9 \times 10^{-4}$ g tetraethylammonium borohydride in 70 μl water; 13–35 ma | carbon | 1.00 |
| | | nickel | 0.73 |
| | | nickel | 1.58 |
| II. | $2.1 \times 10^{-1}$ g methyltriphenylphosphonium bromide in 5 ml water; 14–34 ma | carbon (ave. of 4) | 1.00±.10 |
| | | nickel | 1.39 |
| | | nickel | 4.91 |
| | | nickel | 3.47 |
| III. | 2.0 g ascorbic acid in 10 ml water; 5–28 ma | carbon | 1.00 |
| | | nickel | 0.54 |
| | | nickel | 0.64 |
| | | nickel | 0.59 |
| | | nickel | 0.57 |
| IV. | $2 \times 10^{-2}$ g pyridoxal phosphate in 2 ml water; 10–30 ma | carbon | 1.00 |
| | | nickel | 2.54 |
| | | nickel | 1.06 |
| V. | 2.0 g glucuronolactone in 10 ml water; 6–40 ma | carbon | 1.00 |
| | | nickel | 0.30 |

EXAMPLE 2

Silver needle-like dendrites were grown using the apparatus of FIG. 1. Dendrites having a length up to 15 μm were grown using a 4 M silver nitrate solution at room temperature and applying 10 pulses of 0.001 pulse duration and 30 V peak amplitude each to the cell. A platinum anode placed 1 cm. from the cathode was used.

EXAMPLE 3

Fern-like cobalt dendrites were grown using the apparatus shown in FIG. 1. Dendrites having a length of up to 40 μm were grown using a 4 M and a nearly saturated solution of cobalt chloride respectively. The growth was accommplished at 90° C. by applying 10–15 pulses of 0.001 second duration and 30 volts peak amplitude each to the cell. The anode employed was platinum anode placed 1.0 cm. from the emitter wire.

EXAMPLE 4

Manganese dendrites were grown using the apparatus shown in FIG. 1. Dendrites having a length of up to 40 μm were grown using a nearly saturated manganese sulfate solution at 5° C. through which 20–25 pulses or 0.001 second duration and 25–30 volts peak voltage were applied. The anode used was an alloy containing 99% lead and 1% silver. The structures were branched but had a burr-like appearance. Attempts to grow these dendrites at higher temperatures yielded shorter and less branched needles.

EXAMPLE 5

Manganese dendrites of 15 μm were also generated using the apparatus shown in FIG. 1 and an almost saturated manganese chloride solution at room temperature through which 10 pulses of 0.001 second duration and 30 volts peak voltage were applied.

The above description is intended to exemplify the invention and is in no way intended to limit the scope of the invention as set forth in the following claims.

What is claimed is:

1. A process for forming a field desorption emitter comprising a metal support and a plurality of metallic dendrites attached to and extending in a generally radially outwardly extending direction from said support, said process comprising the steps of:

a. forming an electrolytic liquid mixture having an appropriate concentration of a compound of the metal from which the dendrites are to be formed;
b. immersing said support, as a first electrode, in said mixture;
c. immersing a second electrode in said mixture in electrodepositing association with said support; and
d. applying a plurality of short duration pulses of electrical current with substantially zero current between said pulses across said electrodes.

2. The process of claim 1 further comprising the step of optimizing the temperature of said mixture while applying said electrical pulses.

3. The process of claim 1 wherein the step of forming an electrolytic liquid mixture comprises forming eutectic electrolytic liquid mixture.

4. The process of claim 1 wherein the step of forming an electrolytic liquid mixture comprises forming an electrolytic solution.

5. The process of claim 1 wherein the step of forming an electrolytic liquid mixture comprises forming an aqueous electrolytic solution.

6. The process of claim 1 wherein the step of forming an electrolytic liquid mixture comprises forming an aqueous solution of a compound containing a metal selected from the group consisting of nickel, cobalt, manganese, silver, rhenium, chromium, niobium and tantalum.

7. The process of claim 1 wherein the step of forming an electrolytic liquid mixture comprises forming an aqueous solution of nickel.

8. The process of claim 1 wherein the step of forming an electrolytic liquid mixture comprises forming a eutectic molten salt mixture containing a metal selected from the group of tungsten and molybdenum.

9. The process of claim 1 wherein the step of forming an electrolytic liquid mixture comprises forming an aqueous solution of a compound selected from the group consisting of silver nitrate, nickel chloride, nickel sulfate, nickel nitrate, manganese chloride, and manganese sulfate.

10. The process of claim 1 wherein said support is an elongated support, and the step of forming an electrolytic mixture comprises forming an aqueous electrolytic solution.

11. The process of claim 1 wherein said support is a tungsten wire and the process comprises the step of cleaning said support, prior to immersion in said mixture, by immersing said support in a solution containing nitric and hydrofluric acid, and then washing said support in distilled water.

12. The process of claim 1 wherein the step of applying a plurality of electrical pulses between said electrodes comprises applying at least two series of pulses, separated by a relaxation period during which no electrical pulses are applied between said electrodes.

13. The process of claim 1 wherein the step of applying a plurality of electrical pulses between said electrodes comprises applying pulses having a peak amplitude of at least 5 volts.

14. The process of claim 1 wherein the steps of applying a plurality of electrical pulses between said electrodes comprises first applying pulses having relatively low peak amplitude, allowing a relaxation period, and then applying pulses having a relatively high peak amplitude.

15. The process of claim 1 further comprising the step of cleaning said emitter to remove any residual electrolytic liquid mixture.

* * * * *